United States Patent [19]

Bonner

[11] Patent Number: 4,827,900

[45] Date of Patent: May 9, 1989

[54] STOVE WITH EXTERNAL TUBES FOR INCREASING HEAT DISSIPATION

[76] Inventor: Lester K. Bonner, 3101 E. 112 St., Anch, Ak. 99516

[21] Appl. No.: 727,125

[22] Filed: Apr. 25, 1985

[51] Int. Cl.[4] ..... F24C 1/00

[52] U.S. Cl. ..... 126/60; 126/80; 126/108

[58] Field of Search ..... 126/58, 60, 61, 64, 126/65, 66, 77, 67, 80, 83, 292, 102, 293, 108; 110/203

[56] References Cited

U.S. PATENT DOCUMENTS

| | | | |
|---|---|---|---|
| 11,999 | 11/1854 | Mott | 126/58 |
| 15,613 | 8/1856 | Liddle | 126/102 |
| 65,967 | 6/1867 | Trotter | 126/99 R |
| 110,664 | 1/1871 | Martin | 126/77 |
| 172,014 | 1/1876 | Gold | 126/108 |
| 191,499 | 5/1877 | White | 126/60 |
| 255,849 | 4/1882 | Gold | 126/108 |
| 280,455 | 7/1883 | Cutler | 126/108 |
| 705,928 | 7/1902 | Hevermann | 126/60 |
| 738,069 | 9/1903 | Rose | 126/60 |
| 1,387,359 | 8/1921 | Davis | 126/108 |
| 4,319,557 | 3/1982 | Sietmann et al. | 126/77 |
| 4,373,507 | 2/1983 | Schwartz et al. | 110/203 |
| 4,440,145 | 4/1984 | Neyenhouse | 126/61 |
| 4,987,701 | 5/1893 | Ward | 126/105 R |

*Primary Examiner*—James C. Yeung

*Attorney, Agent, or Firm*—Hall, Myers & Rose

[57] ABSTRACT

A stove has a combustion chamber with front and rear ends. Fuel is fed into the front end and a chimney exhausts the products of combustion from the rear end. A multiplicity of tubes are external to, and parallel to the combustion chamber. Each tube is connected between the front and rear ends of the combustion chamber so that some part of the products of combustion flows through the tube and thus improves its heat dissipation as compared to the heat dissipation of a simple fin. A baffle may be inserted between the front and rear ends of the combustion chamber to increase the flow of combustion products through the tubes.

5 Claims, 1 Drawing Sheet

STOVE WITH EXTERNAL TUBES FOR INCREASING HEAT DISSIPATION

BACKGROUND OF THE INVENTION

It is well known that ordinary wood or coal burning stoves have a relatively low efficiency since much of the heat goes up the chimney. There have been efforts to improve the efficiency of such stoves extending as far back as 150 years. These efforts have included addition of fins to the outside of the combustion chamber, extracting heat from the chimney, etc.

SUMMARY OF THE INVENTION

This invention makes a stop forward in improving the efficiency of a stove by adding a multiplicity of tubes to the outside of the casing forming the combustion chamber. Each tube is spaced outwardly from the outer wall of the combustion chamber to permit cooling air to flow between said casing and the tube. Each tube also has its front end opening into the front end of the combustion chamber and its rear end opening into the rear end of the combustion chamber. There is a pressure drop across the combustion chamber due to the partial vacuum existing at the base of the chimney. This pressure drop forces some of the products of combustion through the tubes referred to above. Thus, the tubes not only perform all of the heat dissipating functions of fins, but, in addition, (1) are directly heated by the products of combustion flowing therethrough and (2) allow for air circulation between each tube and the outer wall of the casing which forms the combustion chamber.

To increase the flow of hot combustion products through the tubes a baffle may be added across the combustion chamber. This baffle may have one or more holes in it of an aggregate size selected to produce maximum efficiency of the stove. The baffle impedes or prevents, as the case may be, direct flow of the products of combustion toward the rear of the combustion chamber and thus forces more of the products of combustion through the tubes.

A conventional catalytic burner may be placed in one or more of the tubes to increase combustion efficiency and reduce creosote build-up in the tubes.

DETAILED DESCRIPTION OF THE DRAWINGS

Figure 1:
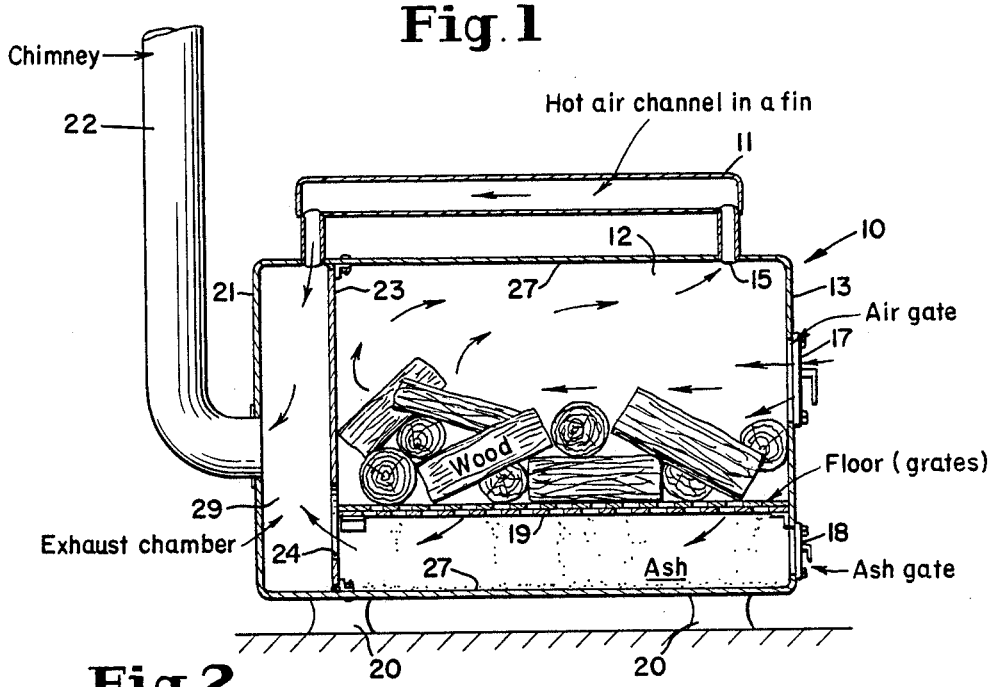
FIG. 1, is a cross-sectional view of the new stove showing a typical tube 11.
Figure 2:
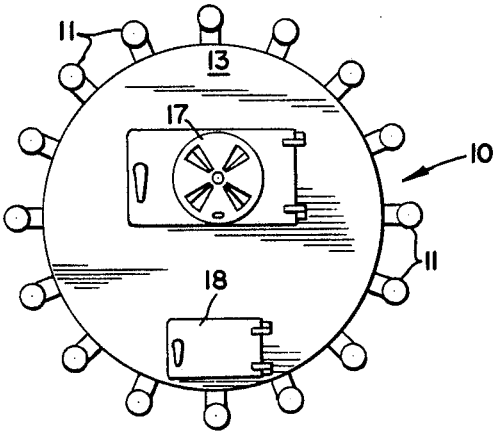
FIG. 2, is a front-end view of the new stove showing sixteen tubes 11.
Figure 3:
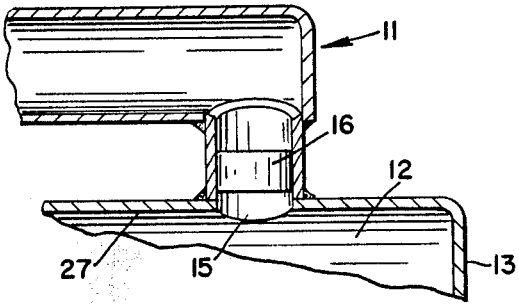
FIG. 3, is a cross-section of the connection between the front end of one of the tubes 11 and the front end of the combustion chamber 12.
Figure 5:
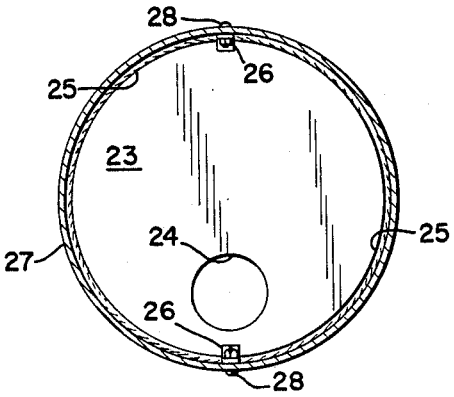
FIG. 5, is a cross-section showing baffle 23, with a gasket 25, mounted onto the wall 27 of casing 10 of FIG. 1.
Figure 4:
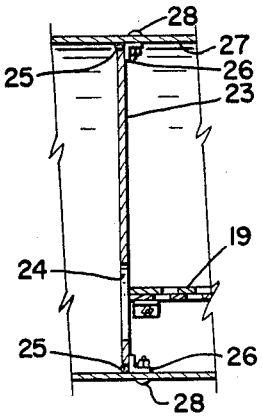
FIG. 4, shows a baffle 23 mounted in the combustion chamber. This baffle is shown without the gasket 25.

In FIG. 1, the tubular casing 10, including the tubular fins 11, may be the casing of a burned-out electrical power transformer. A transformer has up to a total of 64 tubes 11 for circulating cooling oil whereby the heat dissipation is greater than in the case of a simple fin. In FIG. 2 of the drawing only sixteen tubes 11 are shown; however as many may be used as desired. Furthermore, the tubes 11 may be placed in one or more groups around casing 10. For example, there may be two groups, one on each side of the stove (viewed from the front). Similarly, the tubes at the bottom of the stove near legs 20 may be omitted. Each tube 11 opens into the combustion chamber 12 near the front end 13 of that chamber, so that the products of combustion that are formed near the front end of chamber 12 may pass through opening 15 in the wall 27 of casing 10, through the catalytic burner 16, and thence to the rear end of the combustion chamber 12, as shown in FIG. 1. The front end of casing 10 may have a door 17 through which fuel may be fed into the stove and may also have a door 18 through which ashes may be removed from the stove. A conventional grate 19 may be employed. Moreover, the casing 10 may have legs 20 of insulating material for supporting the casing above the floor of a building.

The products of combustion are fed from the rear end 21 of the casing to a chimney 22.

The stove may be made either with or without the baffle 23. Without the baffle 23, there is a natural air flow passing from the front end to the rear end of the combustion chamber 12, resulting from a pressure difference in the combustion chamber. Thus, in the absence of baffle 23, the higher pressure near the front end of combustion chamber 12 will cause some of the products of combustion to flow through the sixteen tubes 11 to the rear end of the combustion chamber 12. This flow through tubes 11 may be enhanced by adding a baffle 23 across the combustion chamber 12, near the rear end thereof.

If baffle 23 is a solid plate it may tend to choke the burning of the fuel. Therefore, the baffle 23 is preferably provided with a hole 24 of such size that maximum heat dissipation, for a given amount of fuel, takes place. This is simply another way of saying that the size of hole 24 is selected to give maximum efficiency to the stove under typical operating conditions.

The baffle 23 may be fitted along its perimeter with a woven asbestos gasket 25. In any event, the baffle 23 is positioned in the casing 10 by brackets 26 which are attached to the outer casing wall 27 by bolts 28.

When baffle 23 is employed, the rear end of the casing 10 forms an exhaust manifold 29 for receiving the products of combustion from the front end of the casing through the multiplicity of tubes 11, and possibly also either directly from the front end of casing 10 (if no baffle is used) or through hole 24.

The catalytic burner 16 is optional. When used it not only reduces creosote build-up in the tubes but adds heat since the products of combustion are further burned in the burners 16.

I claim to have invented:

1. In a stove of the type adapted to be connected to a chimney, for dissipating substantially all of the heat from the stove, except that which goes up the chimney, into any room in which the stove may be placed:

stove means for dissipating the heat from the products of combustion, except for the heat which goes up the chimney, into any room into which the stove may be placed, said stove means including walls forming a combustion chamber and including an exhaust outlet for feeding the chimney, said walls having an outer surface for dissipating heat, numerous horizontal pipes, each pipe being located wholly outside of said combustion chamber and having an outlet end for feeding products of combustion to said exhaust outlet and having an inlet end for receiving products of combustion directly from said combustion chamber at a location remote from said exhaust outlet, said stove means comprising means for passing a substantial quantity of the products of combustion through said pipes to heat the same, said pipes being substantially spaced from said outer surface throughout most of their length, to permit some of the air of the room being heated by the stove to pass between said outer surface and said pipes, so as to increase the efficiency of heating the air of the room in which the stove is located, said pipes being substantially spaced from each other to allow the air that is heated between said outer surface and a pipe to escape between such pipes directly into any room in which the stove is located.

2. In a stove as defined in claim 1 in which said combustion chamber has first and second ends connected by said outer surface with said exhaust outlet at or near said second end, said first ends of said pipes opening directly into said combustion chamber at or near said first end of said combustion chamber.

3. In a stove as defined in claim 2:

said numerous horizontal pipes adding heat to most of the air that passes across said outer surface that is located between said first and second ends of said combustion chamber.

4. In a stove as defined in claim 2:

said numerous horizontal pipes heating most of the air that passes by convection across the outer surface of said combustion chamber between said ends of said chamber and thereafter passes between at least two of said pipes into the room being heated.

5. In a stove:

a combustion chamber having a grate area over which fuel may be burned, said combustion chamber defining an opening through which fuel may be fed to said grate area, said combustion chamber having an outer wall, a flue having a flue inlet fed by said combustion chamber, said flue inlet being of small cross-section compared to said grate area, a multiplicity of pipes for increasing the heat dissipation from the stove, each pipe having an inlet end and an outlet end, each such outlet end being connected to said combustion chamber so as to feed said flue inlet, and each said inlet being connected directly to said combustion chamber at a location remote from said flue inlet, so that at least some of the products of combustion will flow through said pipes to said flue inlet, each of said multiplicity of pipes being wholly outside of said combustion chamber and spaced away from said outer wall a sufficient distance to allow substantial convection currents of air to flow between said outer wall and said pipes so that convection air currents will surround the pipes and thus dissipate heat from the stove, said combustion chamber defining substantially direct air paths within the combustion chamber from the various parts of said grate area to said flue inlet, so that at least some of the products of combustion from the entire grate area may pass inside the combustion chamber to the flue inlet by traveling in the same general direction as the path taken by the products of combustion going through said pipes, said combustion chamber being elongated, the axis of the chamber in its elongated direction being horizontal, said combustion chamber having a flue end at one end of said axis, said flue inlet connecting with the combustion chamber at or near said flue end, said combustion chamber having another end opposite to said flue end, said pipes extending generally parallel to said axis with each pipe communicating with said flue end and also communicating with said combustion chamber adjacent said another end.

* * * * *